US006521063B1

(12) United States Patent
Warren et al.

(10) Patent No.: US 6,521,063 B1
(45) Date of Patent: Feb. 18, 2003

(54) CONDUCTIVE POLYMERS TO IMPROVE PROPELLANT INSENSITIVITY-IMPACT AND FRICTION-PROPERTIES

(75) Inventors: Larry C. Warren, Huntsville, AL (US); Darren M. Thompson, Madison, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/977,909

(22) Filed: Oct. 12, 2001

(51) Int. Cl.[7] ..... C06B 45/10; C06B 31/00; C06B 31/28

(52) U.S. Cl. ..... 149/19.4; 149/45; 149/46

(58) Field of Search ..... 149/19.4, 45, 46

(56) References Cited

U.S. PATENT DOCUMENTS 3,981,240 A * 9/1976 Gladden ..... 102/29
5,074,938 A * 12/1991 Chi ..... 149/21
5,078,813 A * 1/1992 Tucker et al. ..... 149/7
5,463,954 A * 11/1995 Blair ..... 102/202
5,859,383 A * 1/1999 Davison et al. ..... 102/307
6,183,574 B1 * 2/2001 Warren ..... 149/109.6

* cited by examiner

*Primary Examiner*—Michael J. Carone
*Assistant Examiner*—Aileen B. Felton
(74) *Attorney, Agent, or Firm*—Arthur H. Tischer; Freddie M. Bush

(57) ABSTRACT

Tactical missile propellant formulations are inherently sensitive to impact and friction stimuli. The impact and friction insensitivity of some tactical propellant formulations is improved significantly when internal conductive polymers PERCOL®292, (copolymer of a quaternary acrylate salt and acrylamide, Allied Colloids, Inc.) and VERSICON®, (Polyaniline)(Emeraldine salt), green/black powder, Monsanto Company) are added to the formulation. These two conductive polymers were evaluated in a high performance propellant formulation containing the same ingredients now being used in fielded tactical missiles. The impact and friction insensitivity of propellants containing these conductive polymers was improved thirty and sixty six percent, respectively.

3 Claims, No Drawings

CONDUCTIVE POLYMERS TO IMPROVE PROPELLANT INSENSITIVITY-IMPACT AND FRICTION-PROPERTIES

DEDICATORY CLAUSE

The invention described herein may be manufactured, used, and licensed by or for the Government for governmental purposes without the payment to us of any royalties thereon.

BACKGROUND OF INVENTION

Two conductive polymers PERCOL® 292, (copolymer of a quaternary acrylate salt and acrylamide, Allied Colloids, Inc.) and VERSICON®, (Polyaniline)(Emeraldine salt), green/black powder, Monsanto Company) were evaluated in a potential minimum signature tactical missile propellant formulation. Tactical minimum signature propellants rely heavily on the energetic nitramines to achieve high performance. Energetic nitramines are the major ingredients used in most minimum signature propellant formulations, in missile warheads and for gun propellant applications. The most widely used energetic nitramines RDX (trimethylene trinitramine) and HMX (tetramethylene tetranitramine) are very sensitive to impact and friction stimili. Propellants formulations containing high percentages of RDX and HMX are all very sensitive to impact and friction stimuli.

The purpose of evaluating conductive polymers was to determine if static electricity buildup within the propellant formulation had any effect on the friction and impact properties of a minimum signature propellant.

SUMMARY OF INVENTION

Conductive Polymers (PERCOL® 292 and VERSICON®) were added to a typical minimum signature propellant and the propellant formulation was evaluated for impact and friction sensitivity. These two conductive polymers evaluated are described in Table I. The minimum signature propellant formulation used in the initial evaluations is outlined in Table II. The results obtained in these experiments can apply to both warhead and gun propellant formulations that contain higher percentages of the energetic nitramines RDX and HMX.

TABLE I

| Conductive polymers evaluated |
|---|
| PERCOL ®292, Copolymer of a quaternary acrylate salt and Acrylamide, Allied Colloids, Inc. |
| VERSICON ®, Polyaniline (Emeraldine salt), green/black powder, Monsanto Company |

TABLE II

| Typical Minimum Signature | |
|---|---|
| Propellant Formulation | Ingredients % |
| POLYMER(s) | 7.00 |
| BTTN | 19.61 |
| TMETN | 8.41 |
| OXIDIZER(s) | 57.50 |
| MNA | 0.50 |
| CARBON | 0.25 |
| Ballistic catalysts | 4.50 |
| N100 | 1.73 |
| Conductive polymer(s) | 0.50 |

TABLE II-continued

| Typical Minimum Signature | |
|---|---|
| Propellant Formulation | Ingredients % |

NOTE OXIDIZER (S) = RDX, HMX, AMMONIUM NITRATE CATALYSTS = BISMUTH β-RESORCYLATE, ZrC POLYMER (S) = ORP-2, PGA, CAPROLACTONES, etc.

The results of the findings were compared to a baseline formulation containing no antistatic agent. The results of these findings are outlined in Table III. The PERCOL® 292 improved the friction insensitivity significantly at the one percent level. This increase in friction was superior to the results achieved with VERSICON® at the same percent level. However, the VERSICON® improved impact insensitivity properties at the one half percent concentration while the PERCOL® 292 made the propellant more sensitive to impact. At the one-half and one percent concentrations of the conductive polymers, performance of the propellant was sacrificed. The lower concentrations of polymers are more desirable to achieve improvements in impact and friction insensitivity while maintaining high performance.

TABLE III

Initial results using PERCOL ® 292 and VERSICON ®

| | BASE-LINE | MM-35 | MM-36 | MM-37 | MM-38 | MM-41 |
|---|---|---|---|---|---|---|
| % PERCOL ® 292 | 0 | 0 | 0 | 0.5 | 1.0 | 0 |
| % VERSICON ® | 0 | 0.5 | 1.0 | 0 | 0 | 0.25 |
| IMPACT, (kg-cm) | 100 | 120 | 105 | 90 | 80 | 90 |
| FRICTION, (psi) | 150 | 150 | 150 | 350 | 350 | 175 |

DESCRIPTION OF PREFERRED EMBODIMENT

The preferred concentration levels of the conductive polymer(s) is less than one half percent. At this concentration performance is not significantly reduced. A propellant formulation (PM-070) was processed containing one fourth percent of each PERCOL® 292 and VERSICON®. The formulation is outlined in Table IV. The results of the impact and friction determination are outlined in Table V along with additional determinations at lower concentrations of the two conductive polymers. The impact and friction properties are improved significantly over the baseline formulation when both polymers are used together in the formulation. Additional determinations may suggest that similar results can be achieved with only the VERSICON® (MM-47). The PERCOL® 292 does not appear to be as effective for both impact and friction.

TABLE IV

| Preferred Minimum Signature Propellant Formulation | |
|---|---|
| Ingredients | % |
| ORP-2 | 7.00 |
| BTTN | 19.61 |
| TMETN | 8.41 |

TABLE IV-continued

| Preferred Minimum Signature Propellant Formulation | |
|---|---|
| Ingredients | % |
| RDX | 47.50 |
| AN | 10.00 |
| MNA | 0.50 |
| CARBON | 0.25 |
| ZrC | 1.00 |
| Bi β-R | 3.50 |
| N100 | 1.73 |
| VERSICON ® | 0.25 |
| PERCOL ®292 | 0.25 |

TABLE V

Impact and Friction data using PERCOL ®292 and VERSICON ®.

| | BASELINE | MM-43 | MM-47 | PM-070 |
|---|---|---|---|---|
| % PERCOL ®292 | 0 | 0.25 | 0 | 0.25 |
| % VERSICON ® | 0 | 0.25 | 0.05 | 0.25 |
| IMPACT (kg-cm) | 100 | 90 | 130 | 130 |
| FRICTION (psi) | 150 | 175 | 300 | 250 |

Notes:

1. These formulations are illustrations. Binder (polymer+plasticizer+curing agent) percents can vary to obtain optimum propellant properties.
2. The concentration of energetic nitramine ingredients could change impact and friction values and change the amount of conductive polymer needed.
3. Ingredients defined:

A1120 amine bonding agent

AN permalene ammonium nitrate-oxidizer

ORP-2 energetic nitramine polymer, developed by Olin Corporation

BTTN butanetriol trinitrate-plasticizer

CARBON carbon black

Ballistic-modifiers bismuth compounds-bismuth β-resorcylate (Bi β-R)

HMX tetramethylene tetranitramine

MNA N-methyl para nitroaniline-chemical aging stabilizer

N100 triisocyanate, curing agent

ORP-2 energetic nitramine polymer

Oxidizer(s) AN, HMX, RDX

PERCOL® 292 copolymer of a quaternary acrylate salt and acrylamide

RDX trimethylene trinitramine

TMETN trimethylolethane trinitrate-plasticizer

VERSICON® polyaniline (emeraldine salt (green)) conductive polymer, average molecular weight about 75,000.

ZrC zirconium carbide-ballistic stabilizer

We claim:

1. A minimum signature propellant formulation containing conductive polymers and having improved propellant insensitivity-impact and friction-properties, said minimum signature propellant formulation comprising in weight percent amounts of ingredients as follows:

i. an energetic nitramine polymer from about 6.00 to about 7.00;

ii. a plasticizer selected from butanetriol trinitrate plasticizer of about 19.61 and trimethyolethane trinitrate plasticizer of about 8.41;

iii. carbon black in an amount from about 0.25 to about 0.50;

iv. an oxidizer blend of ammonium nitrate of about 10.00, and an oxidizer selected from tetramethylene tetranitramine, and trimethylene trinitramine of about 47.50;

v. conductive polymers selected from a copolymer of quaternary acrylate salt and acrylamide and polyaniline emeraldine salt of about 0.25 to about 0.50;

vi. ballistic-modifiers selected from bismuth β-resorcylate and zirconium carbide; of about 1.0 to about 4.50;

vii. a triisocyanate curing agent of about 1.73; and, viii. N-methyl paranitroaniline-chemical aging stabilizer of about 0.50.

2. The minimum signature propellant formulation containing conductive polymers and having improved propellant insensitivity-impact and friction-properties as disclosed in claim 1 wherein said conductive polmers are a copolymer of quaternary acrylate salt in an amount of about 0.25 and polyaniline emeraldine salt of about 0.25.

3. The minimum signature propellant formulation containing conductive polymers and having improved propellant insensitivity-impact and friction-properties as disclosed in claim 1 wherein said conductive polmer is polyaniline emeraldine salt of about 0.05.

* * * * *